US005474470A

United States Patent [19]

Hammond, Jr.

[11] Patent Number: 5,474,470

[45] Date of Patent: Dec. 12, 1995

[54] COMPENSATED INTERFACE COAXIAL CONNECTOR APPARATUS

[75] Inventor: Bernard H. Hammond, Jr., Naugatuck, Conn.

[73] Assignee: ITT Corporation, New York, N.Y.

[21] Appl. No.: 220,126

[22] Filed: Mar. 30, 1994

[51] Int. Cl.[6] ..... H01R 9/05

[52] U.S. Cl. ..... 439/578; 439/675

[58] Field of Search ..... 439/578, 585, 439/675

[56] References Cited

U.S. PATENT DOCUMENTS

| | | | |
|---|---|---|---|
| 3,112,977 | 12/1963 | Long et al. . | |
| 3,406,376 | 10/1968 | Varrin . | |
| 3,525,973 | 8/1970 | Kipnes . | |
| 4,122,416 | 10/1978 | Oblak et al. | 439/578 |
| 4,290,663 | 11/1981 | Fowler et al. | 439/578 |
| 4,358,174 | 11/1982 | Dreyer | 439/249 |
| 4,360,244 | 11/1982 | Forney, Jr. et al. | 439/581 |
| 4,580,862 | 4/1986 | Johnson | 439/585 |
| 4,619,496 | 10/1986 | Forney, Jr. et al. | 439/434 |
| 4,690,481 | 9/1987 | Randolph | 439/585 |
| 4,708,666 | 11/1987 | Fisher, Jr. | 439/580 |
| 4,898,545 | 2/1990 | Endo et al. | 439/578 |
| 4,904,206 | 2/1990 | Laudig et al. | 439/578 |
| 4,917,630 | 4/1990 | Hubbard | 439/578 |
| 4,925,403 | 5/1990 | Zorzy | 439/578 |
| 4,943,245 | 7/1990 | Lincoln | 439/578 |
| 4,971,578 | 11/1990 | Wilson | 439/578 |
| 4,988,963 | 1/1991 | Shirosaka et al. | 439/578 |
| 5,066,249 | 11/1991 | Doye et al. | 439/585 |
| 5,074,809 | 12/1991 | Rousseau | 439/675 |
| 5,078,620 | 1/1992 | Verhoeven | 439/578 |
| 5,147,230 | 9/1992 | Plyler et al. | 439/843 |
| 5,269,702 | 12/1993 | Bacher et al. | 439/578 |

*Primary Examiner*—David L. Pirlot
*Assistant Examiner*—Jill DeMello
*Attorney, Agent, or Firm*—Freilich Hornbaker Rosen

[57] ABSTRACT

First and second arrays of easily mated coaxial connectors are provided, which are of compact construction to enable efficient transmission of very high frequencies and in a compact arrangement. The outer conductor (22, FIG. 5) of a first connector (1) includes a male outer contact part (44) which is received in a female outer contact part (46) of the second connector, which leaves a step (70) where the inside surface of the male contact part is smaller than that of the adjacent female contact part, thereby creating a capacitive discontinuity. The front ends (74, 76) of the dielectric members (24, 34) of the first and second connectors are slightly axially spaced apart to leave a gap (72) between them. The gap produces an inductance that cancels the effect of the capacitance created by the step, to minimize insertion and return losses. The fact that the compensating gap and step are present avoids the need for a butt interface of the outer conductors. This enables simple and therefore low cost and compact construction for the connectors.

4 Claims, 4 Drawing Sheets

FIG. 6
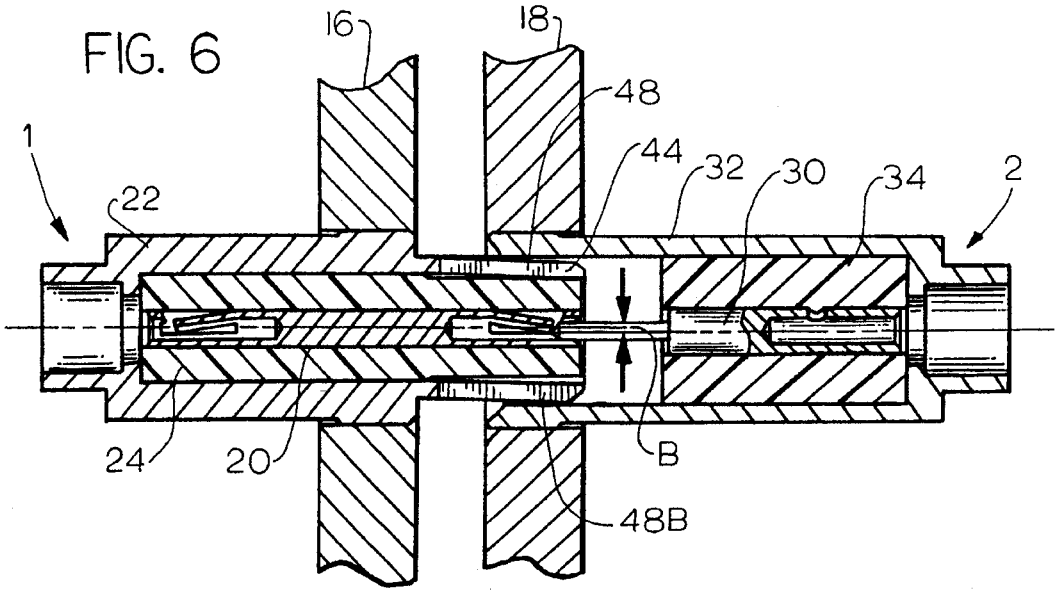
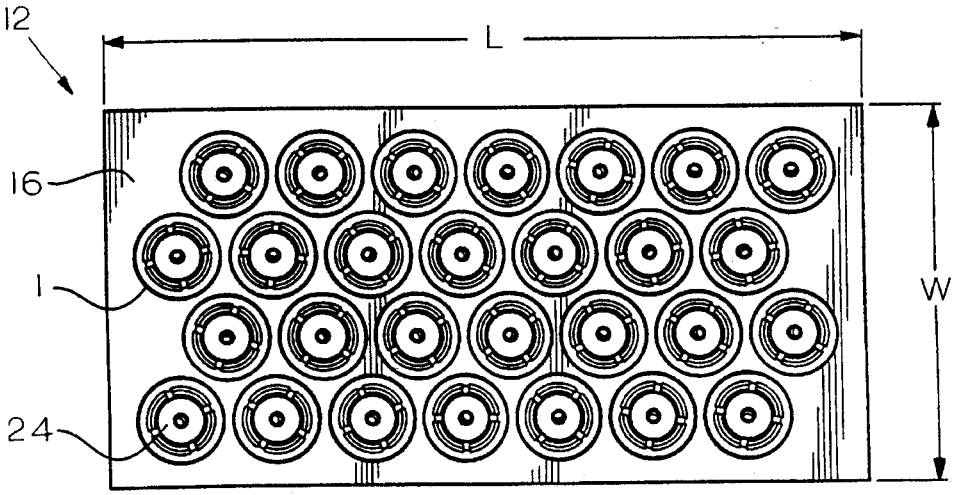
FIG. 7

COMPENSATED INTERFACE COAXIAL CONNECTOR APPARATUS

BACKGROUND OF THE INVENTION

Coaxial connectors have been developed for use in high frequency environments of 18 GHz or more. The inner conductors of two connectors can be connected in a simple pin-and-socket connection. The outer conductors are preferably connected in a butt configuration, wherein the extreme outer ends of the two connectors abut each other, as this results in a constant inside diameter between connectors. However, if a butt connection is used, care must be taken to assure that the two outer contacts are always electrically connected together, and that there is substantially no gap at their interface. Gaps can be eliminated by floating one of the outer conductors so it is resiliently pressed against the other outer conductor, but such floating adds complication. U.S. Pat. No. 4,358,174 shows a slide-on coaxial connection arrangement with an abutment of outer conductors, but which is relatively complex. If a pair of coaxial connectors could be mated without the need for precise abutting of outer contacts, but without substantial losses, then the connectors could be constructed more compactly and at lower cost. It would be desirable if such connectors could be mated by sliding one into the other, so that a compact array of first and second connectors could be easily mated.

SUMMARY OF THE INVENTION

In accordance with one embodiment of the present invention, a coaxial connection apparatus is provided of a slide-on mating construction, which is of relatively simple and compact construction. First and second connectors are constructed so a male outer contact part of a first connector is received in a female outer contact part of a second connector. This results in the front end of the male contact part having a smaller inside diameter than an adjacent location of the female contact part. The dielectric members that lie within the outer conductors, are positioned with a gap between them, and the second dielectric member has a greater outside diameter at the gap than the outside diameter of the first dielectric member at the gap. The step in inside diameters of the male and female outer contact parts results in a capacitive discontinuity. However, the gap between the ends of the dielectric members results in an inductance that counteracts the capacitance, to produce a low loss through the connection. The connectors are of relatively simple construction, so they can be constructed compactly and at low cost.

The novel features of the invention are set forth with particularly in the appended claims. The invention will be best understood from the following description when read in conjunction with the accompanying drawings.

BRIEF DESCRIPTION OF THE DRAWINGS

FIG. 6 is a sectional side view of the apparatus of FIG. 4, showing the connectors during mating, and with slight misalignment of one connector with respect to the other.

FIG. 7 is a front elevation view of the array of first or jack connectors of the apparatus of FIG. 1.

DESCRIPTION OF THE PREFERRED EMBODIMENT

Figure 1:
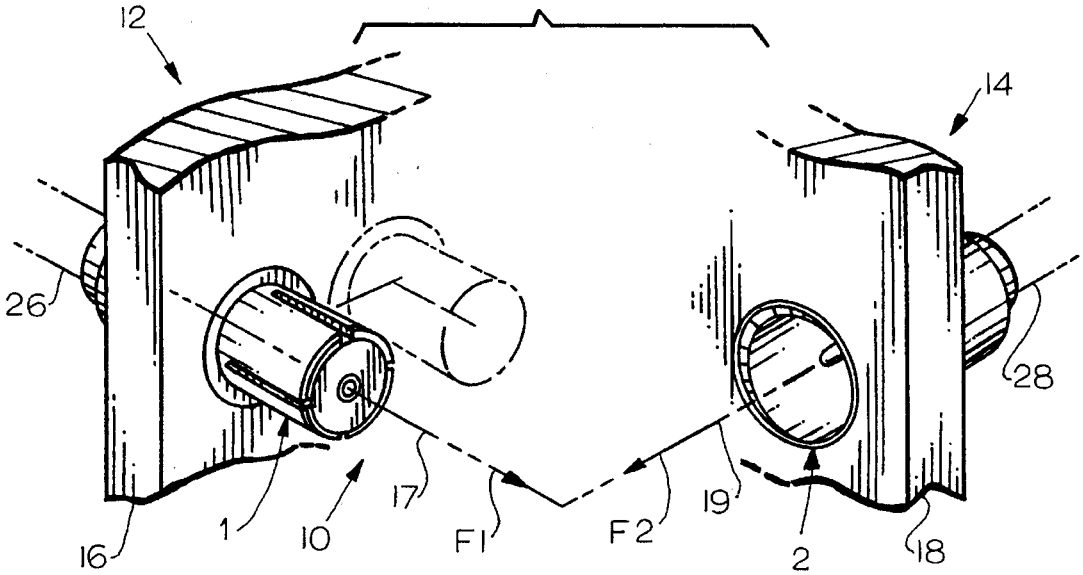
FIG. 1 is a partial exploded isometric view of a coaxial connection apparatus constructed in accordance with the present invention.

FIG. 1 illustrates a coaxial connection apparatus 10 which includes an array 12 of first or jack connectors 1 and an array 14 of second or plug connectors 2. The first connectors 1 are mounted in rows and columns on a panel 16 which forms an apparatus that holds them together. The second connectors 2 are held on a similar panel 18 which holds them together. The first and second connectors 1, 2 can be mated in a slide-on manner, by moving the connectors in corresponding forward directions F1, F2 into each other along axes 17, 19, and can be similarly unmated. Each of the connectors has a rear end connected to a coaxial cable 26, 28.

Figure 2:
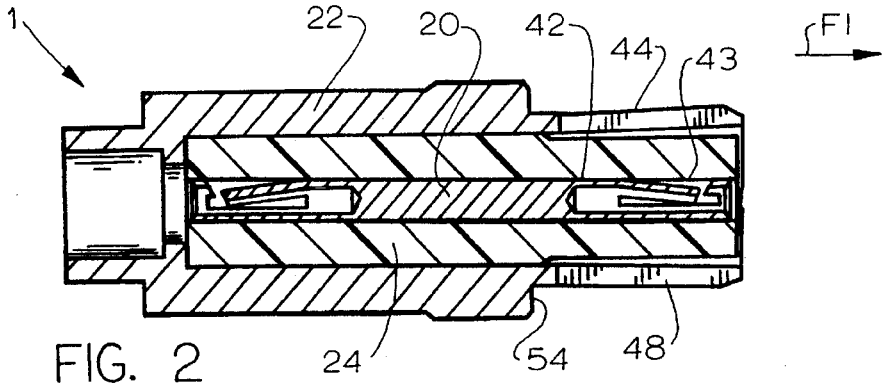
FIG. 2 is a sectional side view of a first or jack connector of the apparatus of FIG. 1.
Figure 3:
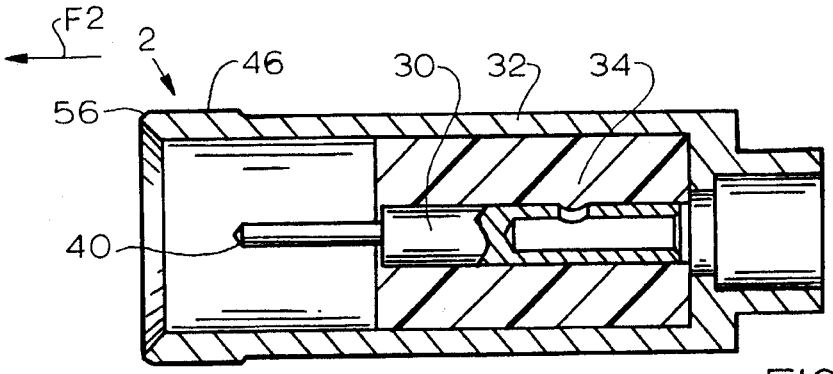
FIG. 3 is a sectional side view of a second or plug connector of the apparatus of FIG. 1.

FIG. 2 shows that each jack or first connector 1 includes first inner and older conductors 20, 22 and a first insulator or dielectric member 24 that lies between the conductors. FIG. 3 shows that the plug or second connector 2 includes second inner and outer conductors 30, 32 and a second insulator or dielectric member 34 lying between them. When the connectors are mated, a pin contact 40 of the second connector is inserted into a socket contact 42 of the first connector that has a single spring tine 43. Similarly, a male outer contact part 44 of the first connector is inserted into a female outer contact part 46 of the second connector. The male contact part 44 has slits that leave spring fingers 48 to assure firm engagement with the female contact part.

Figure 4:
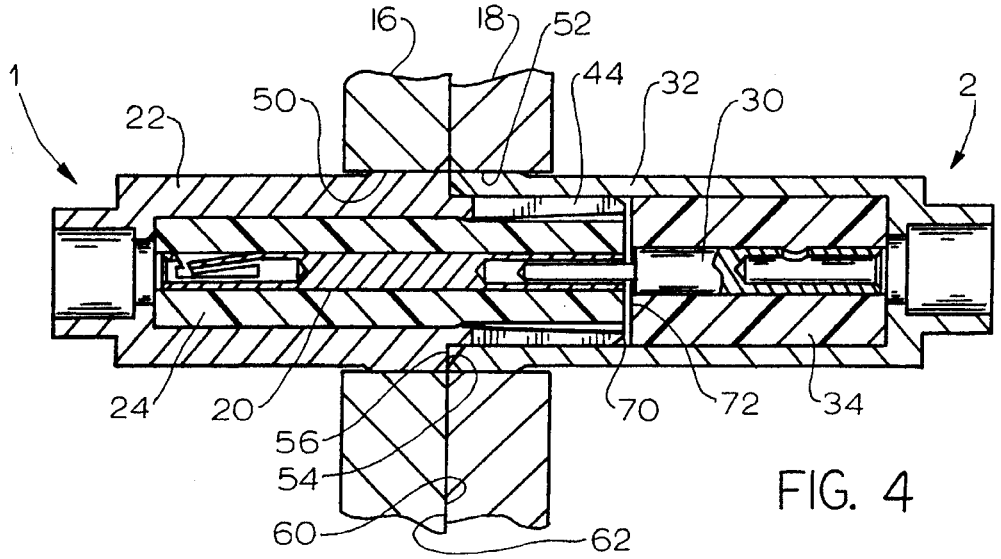
FIG. 4 is a sectional side view of the first and second connectors of FIGS. 1 and 2, shown in their fully mated positions.

FIG. 4 shows the first and second connectors 1, 2 in their fully mated positions with panel faces 60, 62 touching. The first connector has been mounted on the first panel 16 by forcefit into a hole 50 thereof. Similarly, the second connector has been mounted on the second panel 18 by forcefit into a hole 52 thereof. The outer conductors 22, 32 have shoulders ,54, 56 which are mounted substantially flush with the adjacent faces 60, 62 of the panels. The inner conductors 20, 30 are mated by a pin-and-socket connection. The outer conductors are mated by reception of the male contact part 44 in the female contact part 46. Although there is a good low frequency connection of the outer contact parts 44, 46 due to the spring fingers, there can be losses at high frequencies due to the step at 70 where there is a substantial difference in inside diameters between the front end 90 of the first outer conductor part and adjacent locations 94 of the second outer conductor part. Such a step results in a capacitance which could prevent the connectors from transmitting high frequency signals in the gigahertz range.

Figure 5:
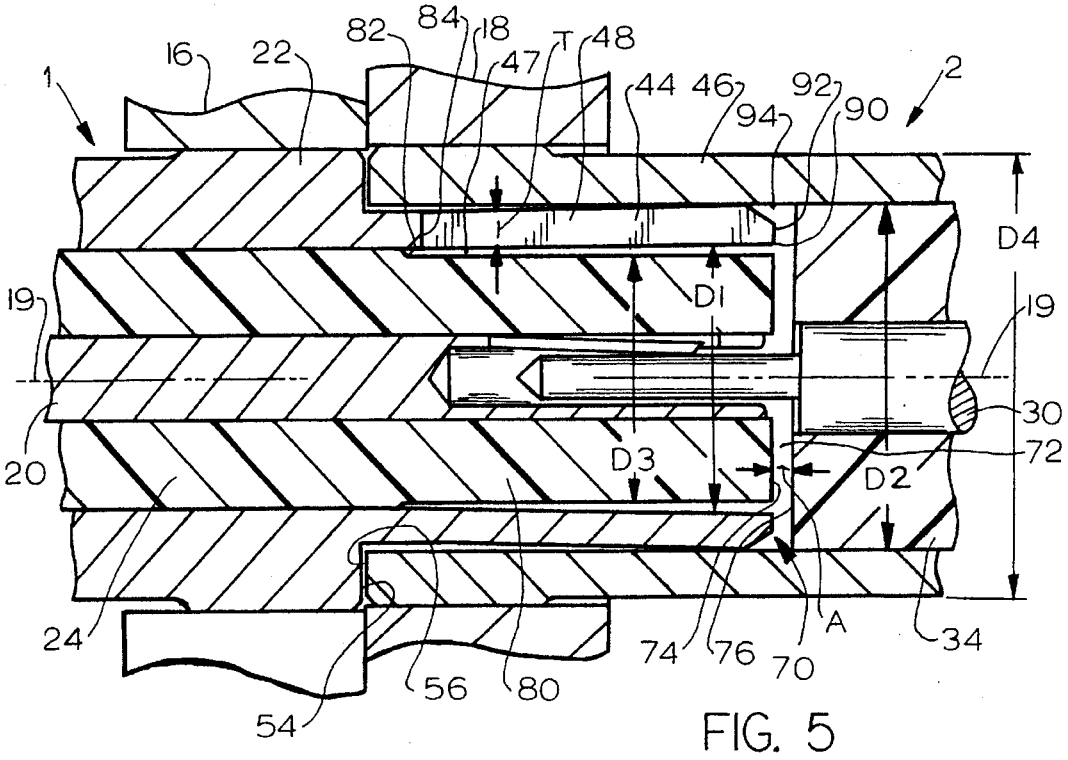
FIG. 5 is an enlarged view of a portion of the apparatus of FIG. 4.

An inductance results from the presence of a gap 72 between the front ends 74, 76 of the first and second dielectric members 24, 34. This inductance is countered by the capacitance resulting from the step 70. As shown in FIG. 5, the first dielectric member 24 has a front portion 80 with an outer diameter D3. This diameter D3 is slightly smaller than the inside diameter D1 of the male contact part 44. That is because the first dielectric has a slightly reduced diameter forward of a location 82 which is just behind the rear ends of the spring fingers at 84, to permit the spring fingers to deflect radially inwardly very slightly. The inside diameter D2 of the female contact part 46 is greater than the diameter D1, with the difference D2 minus D1 being dependent upon the axial length A of the gap 72 between the front ends of the dielectric members. The difference in diameters D2 minus D1 produces a capacitance and the length A of the gap between them produces an inductance. It is desirable that the inductance be between 50% and 150% of the capacitance caused by the step 70 in inside diameters of the outer conductors to offset at least half of the inductance but no more than 150% of it, so the capacitance and inductance are roughly or approximately equal. The step 70 is between the inside location 90 of the front end 92 of the male contact part 44, and a location 94 on the inside surface of the female part that lies adjacent to the male contact part from end 92. The counteracting induction caused by the gap of length A is fortunate, in that a gap 72 will always occur, due to manufacturing tolerances, if pluralities or arrays of first and second connectors are each fixed to corresponding panels 60, 62 or other apparatus that fixes them in relative positions, as compared to prior art floating mounts.

Applicant has constructed connectors of the construction shown, wherein each outer conductor had a diameter D4 of one-eighth inch (0.125 inch or 3.18 mm). The inner and outer conductors were formed of metal and the dielectric members were formed of TEFLON which is a dielectric constant of 2.0. Applicant was able to construct the connectors so when each was mounted on a panel with its shoulder 54, 56 flush with a corresponding panel surface, the length A of each gap was between 0 and 10 mils (1 mil equals one-thousandth inch), or an average of 5 mils. For substantially all (except one or two) of the mating pairs of connectors, there is a gap of more than 0 (i.e. they do not make contact). The female contact part 46 and the second dielectric member each had an outer diameter D2 of 84 mils. Applicant found that the capacitance and inductance roughly cancel to produce a low insertion loss, when the diameter D1 of the male contact part 44 is about 64 mils. Applicant achieved this by making the male contact part 44 have a thickness T of about 10 mils, leaving about a 1.5 mil clearance at 47 for inward deflection of the spring fingers 48, but with the dielectric member still occupying substantially all of the space (over 80%) between the inner and outer conductors. The inner conductors had a step in diameters from locations at 20 to 30 from 22 mils to 29 mils respectively, to maintain a 50 ohm impedance. Thus, for a gap A of an average of 5 mils length, the diameter D2 of the female contact part is preferably about 20 mils (10 to 30 mils) larger or about 130% (115% to 145%) of the diameter D1. Another way of stating this is that the difference in diameters D2 minus D1 is preferably between two and six times the average length A of the gap.

The losses for a pair of mated connectors depends upon the exact size of the gap, but will change only moderately between about 0 and 10 mils. If the range of length of the gap is reduced to haft as much, so that it varies between 0 and 5 mils and averages about 2.5 mils, then reduced losses are obtained by making the diameter D2 only about 20% greater than the diameter D1, and in that case the insertion and return losses will be lower than for the larger gap A of an average of 5 mils. If the tolerances are greater so the gap length can vary between 0 and 20 mils, and is an average of 10 mils, then the diameter D2 should be greater, such as about 60% greater than the diameter D1, to minimize losses even in the case where the gap length A is near the maximum of close to 20 mils. For the above ranges of maximum gap lengths between 0 and 20 mils and an average of 2.5 to 10 mils, which is the range to be expected using current manufacturing techniques with connectors of the construction described having outside diameters D4 of about one-eighth inch, the inside diameter D2 of the female contact portion at 94 ranges from an ideal of between 20% and 60% greater than the inside diameter D1 of the male contact portion at 90 and with a maximum range of between 10% and 90% greater.

FIG. 6 shows that if there is a slight misalignment B in the connectors, this is accounted for by radially inward deflection of one spring finger 48A, and the radially outward deflection of an opposite spring finger 48B. The spring fingers are crimped during manufacture so they spread apart at a small angle, to assure that they will contact the outer conductor of the second connector during mating, the spring fingers permitting proper mating despite slight offset and angular misalignment of the connectors.

Figure 8:
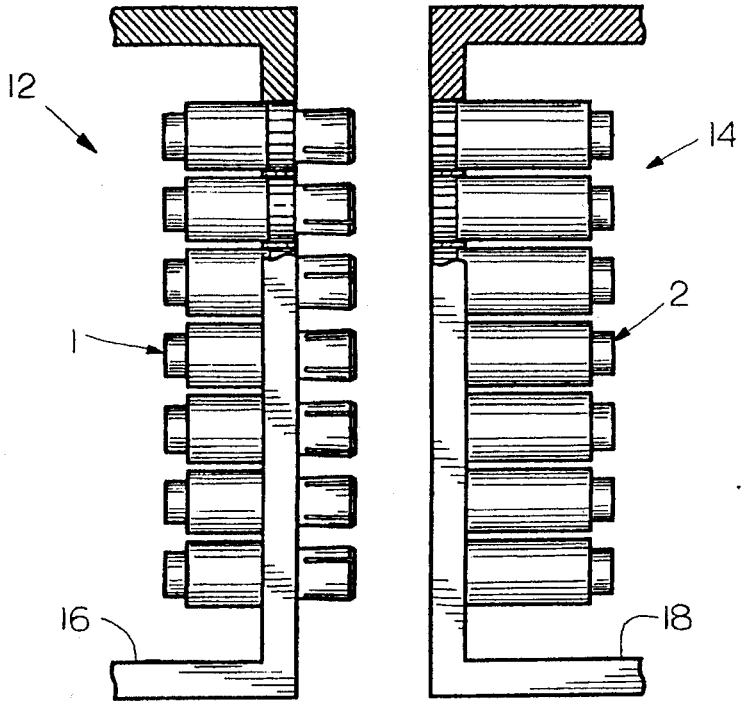
FIG. 8 is an exploded partially sectional side view of the first and second arrays of connectors of FIG. 1.
Figure 9:
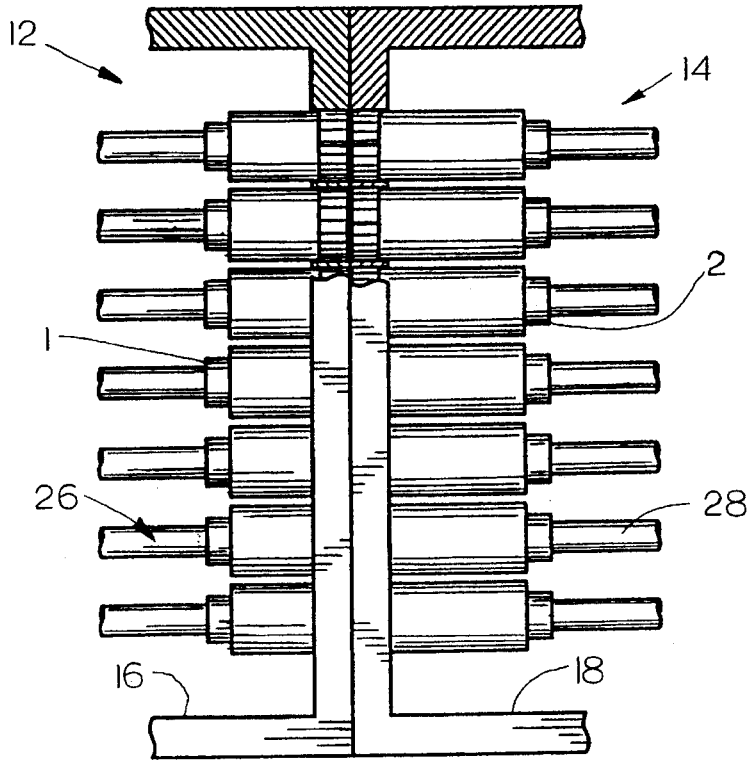
FIG. 9 is a view similar to that of FIG. 8, but with the arrays being mated.

FIGS. 7–9 shows arrays 12, 14 of connectors 1, 2 of the above-described construction that applicant has built and successfully tested. Each array had an overall width W and length L of 0.5 inch (13 mm) and 1.0 inch (25 mm), respectively. The connectors were useful for frequencies of up to 50 GHz, which is greater than the maximum of 18 GHz previously achieved for slide-on connectors.

Thus, applicant provides a male-female interconnection of the outer conductors of a coaxial connector, even though this results in a gap between the front ends of dielectric members and in a step or change in inside diameters of the outer conductors. The step in the outer transmission line results in a capacitance that could result in large losses especially at higher frequencies and that could prevent the use of the connection apparatus at higher frequencies. The effects of such step-caused capacitance, is nullified by an inductance created by the gap between the front ends of the first and second dielectric members. The gap is useful to account for manufacturing tolerances. The difference in diameters of the inside surfaces of adjacent parts of the outer conductor (of the male and female contact portions) is chosen to produce a capacitance that will result in minimal losses for the average gap length and for the range of gap lengths. Where the gap length is increased, a larger difference in diameters of the outer conductors is preferred to minimize losses over the entire gap length, while when a smaller range of gap lengths can be maintained, a smaller difference in diameters is preferred to reduce losses. The relative simplicity of construction which results in only moderate losses, allows the connector to be constructed compactly and at lower cost.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial connection apparatus which includes first and second mateable coaxial connectors that each have an axis with said axes lying substantially coincident when said connectors mate, with said first connector having first inner and outer conductors and a first dielectric member therebetween and said second connector having second inner and outer conductors and a second dielectric member therebetween, characterized by:

said first outer conductor forms a male outer contact part with an inside, and said second outer conductor forms a female contact part with an inside that receives and is engaged with said male contact part, with said male contact part having a front end of smaller inside diameter than that of a location on the inside of said female part that lies around said front end of said male contact part;

said first and second dielectric members have front ends that lie close to each other when said connectors mate, but with an axially extending gap between them;

the inside of said female contact part has a greater diameter at said gap than the inside of said male contact part at said gap; and said male and female contact parts each have an inside diameter at said gap and form an inductance and a capacitance at said gap, with the difference in the inside diameters of said female and male contact parts at said gap being chosen so the inductance and capacitance at said gap are approximately equal.

2. A coaxial connection apparatus which includes first and second mateable coaxial connectors that each have an axis with said axes lying substantially coincident when said connectors mate, with said first connector having first inner and outer conductors and a first dielectric member therebetween and said second connector having second inner and outer conductors and a second dielectric member therebetween, characterized by:

said first outer conductor forms a male outer contact part with an inside, and said second outer conductor forms a female contact part with an inside that receives and is engaged with said male contact part, with said male contact part having a front end of smaller inside diameter than that of a location on the inside of said female part that lies around said front end of said male contact part;

said first and second dielectric members have front ends that lie close to each other when said connectors mate, but with an axially extending gap between them;

the inside of said female contact part has a greater diameter at said gap than the inside of said male contact part at said gap; and the axial length of said gap is about 8% of the inside diameter of said male contact part at said gap, and the inside diameter of said female contact part at said gap is about one-third greater than the inside diameter of said male contact part at said gap.

3. A coaxial connection apparatus which includes an array of substantially identical first jack connectors, an array of substantially identical second plug connectors, and apparatus for holding said arrays of first and second connectors to simultaneously mate and unmate pairs of said connectors, with each of said connectors having an axis and with the axis of each of said first connectors lying substantially coincident with an axis of a mating one of said second connectors when said connectors mate, with said first connectors each having first inner and outer conductors and a first dielectric member therebetween and with said second connectors each having second inner and outer conductors and a second dielectric member therebetween, characterized in that for each pair of mating connectors:

the first outer conductor of the pair forms a male outer contact part with an inside, and the second outer conductor of the pair forms a female contact part with an inside that receives and is engaged with the male contact part, with the male contact part having a front end of smaller inside diameter than that of a location on the inside of the female contact part that lies around said front end of the male contact part;

the first and second dielectric members of the pair have front ends that lie close to each other when the pair of connectors mate, but with an axially extending gap between them;

the inside of the female contact part of the pair has a greater diameter at the gap than the inside of the male contact part of the pair at the gap; and for said pairs of mating connectors of said arrays of connectors, the gaps between the front ends of said dielectric members have an average axial length that is about a predetermined value A, and the female contact parts of the plug connectors have inside diameters D2 at said gaps that are greater than the inside diameters D1 of the male contact parts at said gaps, by about four times the average axial length of said gaps.

4. A coaxial connection apparatus comprising:

a plurality of first coaxial connectors that each includes an axis, a first inner conductor with a front end, a first outer conductor with a front end, and a first insulator with a front end, the front end of the first inner conductor and the front end of the first outer conductor of each of said first connectors forming a space between them, with said first insulator of each of said connectors occupying substantially all of said space;

a plurality of second coaxial connectors that each includes an axis, a second inner conductor with a front end, a second outer conductor with a front end, and a second insulator with a front end that occupies substantially all of the space between the front ends of said second inner and outer conductors;

apparatus that holds said pluralities of first and second connectors mated, wherein one of said inner conductors of each of said first connectors is engaged with one of said inner conductors of each of said second connectors and one of said outer conductors of each of said first connectors is engaged with one of said outer conductors of each of said second connectors and said front ends of said insulators of said first and second connectors lie close to each other;

said first outer conductors lie within said second outer conductors so there is a step in the diameters of their inner surfaces at the front ends of said first outer conductors, and said apparatus holds said connectors so there is an axial space between the extreme front ends of substantially all of said first and said second insulators; and said axial spaces have an average axial length that is between 0.002 inch (0.05 mm) and 0.010 inch (0.25 mm), and the outside diameters of the front ends of said second insulators are between 10% and 90% greater than the outside diameters of the front ends of said first insulators.

* * * * *